US006092561A

United States Patent [19]

Schmid

[11] Patent Number: 6,092,561

[45] Date of Patent: Jul. 25, 2000

[54] THREAD CLAMP FOR A WEAVING MACHINE AND A WEAVING MACHINE WITH A THREAD CLAMP OF THIS KIND

[75] Inventor: Peter Schmid, Glattfelden, Switzerland

[73] Assignee: Sulzer Rueti AG, Rueti, Switzerland

[21] Appl. No.: 09/261,109

[22] Filed: Mar. 3, 1999

[30] Foreign Application Priority Data

Mar. 5, 1998 [EP] European Pat. Off. ..... 98810185

[51] Int. Cl.[7] ..... D03J 5/06; D03D 47/23

[52] U.S. Cl. ..... 139/196.2; 139/196.2; 139/448; 24/132 R

[58] Field of Search ..... 139/438, 447, 139/196.2, 448; 24/132 R

[56] References Cited

U.S. PATENT DOCUMENTS

| | | | |
|---|---|---|---|
| 1,584,680 | 5/1926 | Ambler . | |
| 3,072,155 | 1/1963 | Pfarrwaller et al. | 139/196.2 |
| 4,151,980 | 5/1979 | Burton et al. | 24/132 R |
| 4,541,149 | 9/1985 | Jensen | 24/134 R |
| 5,441,086 | 8/1995 | Nanni | 139/196.2 |

FOREIGN PATENT DOCUMENTS

| | | |
|---|---|---|
| 1325416 | 7/1963 | France . |
| 1444834 | 9/1966 | France . |
| 370720 | 7/1963 | Switzerland . |
| 492475 | 9/1938 | United Kingdom . |

*Primary Examiner*—Andy Falik
*Attorney, Agent, or Firm*—Townsend and Townsend and Crew LLP

[57] ABSTRACT

The thread clamp has cooperating clamping sections with elevations (2) and depressions (3) which extend transverse to the laying-in direction of the thread (4) to be held firmly by the thread clamp. When the clamp is closed, a free space (5) is in each case provided between the elevations (2) and depressions (3) for the reception of a thread (4), and the elevations (2) have an edge (8) for holding back the thread. Through the provision of a free space the thread is exposed to a kinking action and through the edge to a notching action, the cooperation of which ensures a secure holding for the thread.

10 Claims, 2 Drawing Sheets

Fig. 7
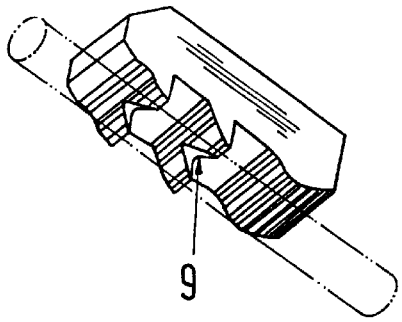
Fig. 8
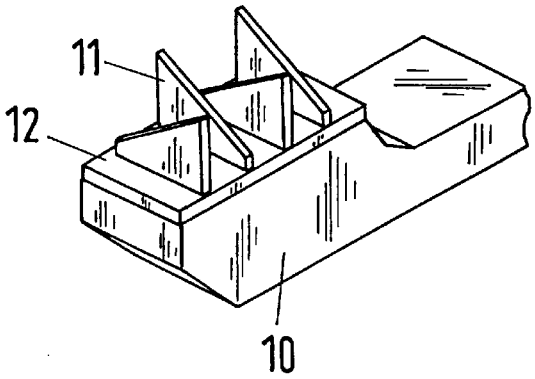
Fig. 9
Fig. 10
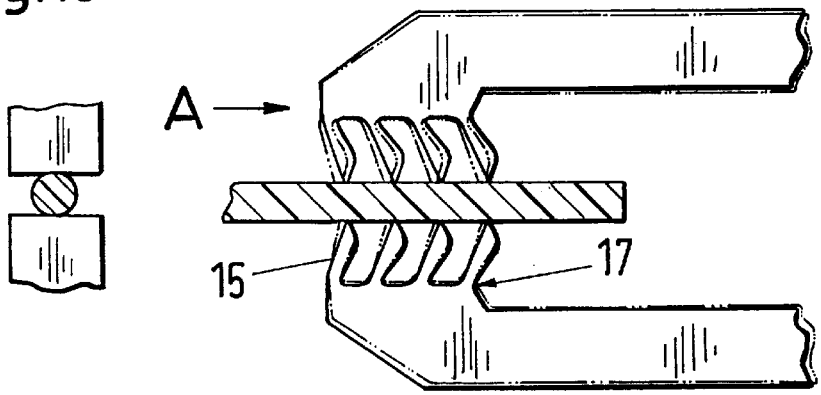
Fig. 11
Fig. 12
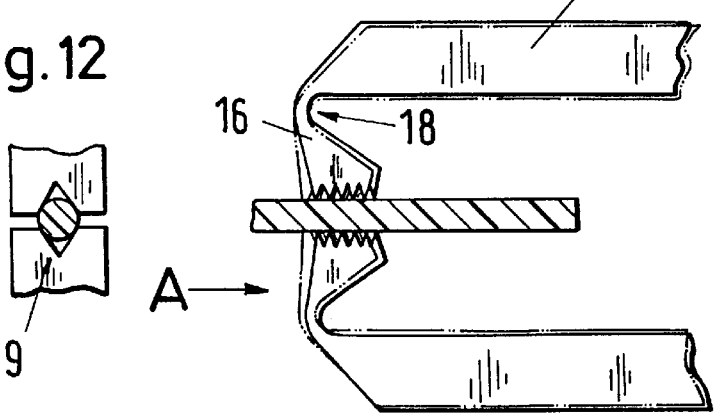

THREAD CLAMP FOR A WEAVING MACHINE AND A WEAVING MACHINE WITH A THREAD CLAMP OF THIS KIND

BACKGROUND OF THE INVENTION

The present invention relates to a thread clamp for a weaving machine and to a weaving machine with a thread clamp of this kind. Swiss Patent CH-A-370 720 discloses a thread clamp which has clamping surfaces formed in the shape of waves, with it being required that the surfaces which touch the thread must lie one upon the other and fit together exactly when the thread is not laid in. This thread clamp is U-shaped and the clamping force is produced only by the elasticity of the limbs. The elevations and depressions are intended to enable a multiple wrapping around or a multiple thickening and thinning of the thread.

It proves disadvantageous that the clamping force of this thread clamp is limited and its use is thereby limited. In particular, technical yarns of plastic and metal with larger thread thicknesses are held in a more or less taut position and substantially held only by friction. Errors in the weft insertion arise as a result of the extremely high initial acceleration during launching, e.g. of one of the thread carriers receiving the thread clamp.

SUMMARY OF THE INVENTION

It is an object of the invention to improve thread clamps.

The advantages which can be achieved with the invention are substantially to be seen in that, through the association of the elevations and depressions, a free space is provided for the thread and the latter is subjected to a kinking action; and in that the edge results in a notching action, so that the thread is held securely.

BRIEF DESCRIPTION OF THE DRAWINGS

FIG. 7 is a perspective illustration of the embodiment shown in FIG. 6*b;*

FIG. 8 is a perspective illustration of a sixth embodiment of a clamping section of a thread clamp made in accordance with the invention;

FIG. 9 shows a seventh embodiment of a clamping section of a thread clamp made in accordance with the invention;

FIG. 10 is a view taken in the direction of the arrow A in FIG. 8;

FIG. 11 shows an eighth embodiment of a clamping section of a thread clamp made in accordance with the invention; and FIG. 12 is a view taken in the direction of the arrow A in FIG. 10.

DESCRIPTION OF THE PREFERRED EMBODIMENTS

Figure 3:
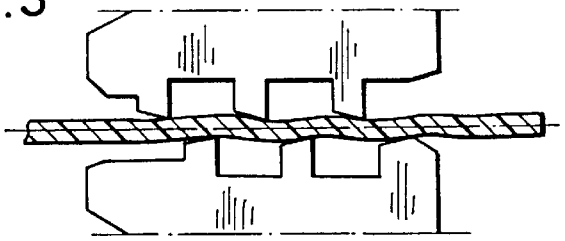
FIG. 3 shows a third embodiment of a clamping section of a thread clamp made in accordance with the invention.
Figure 2:
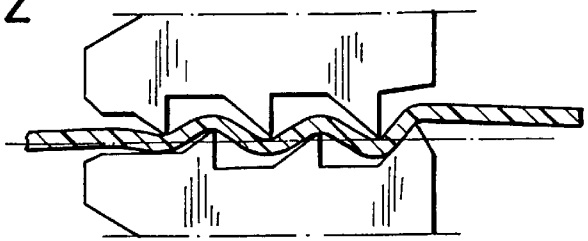
FIG. 2 shows a second embodiment of a clamping section of a thread clamp made in accordance with the invention.
Figure 1:
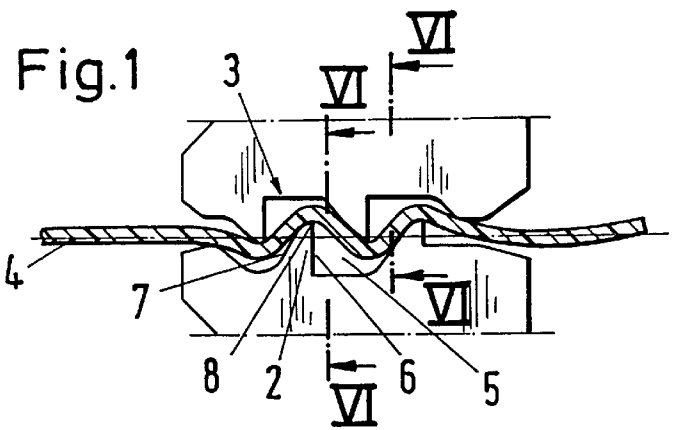
FIG. 1 shows a first embodiment of a clamping section of a thread clamp made in accordance with the invention.
Figure 4:
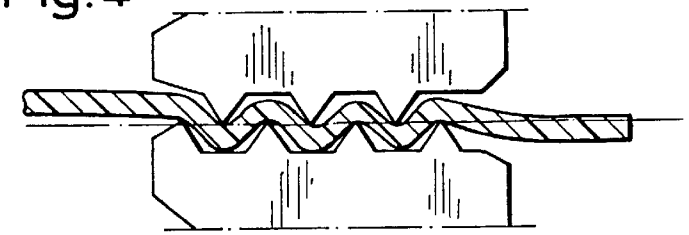
FIG. 4 shows a fourth embodiment of a clamping section of a thread clamp made in accordance with the invention.
Figure 5:
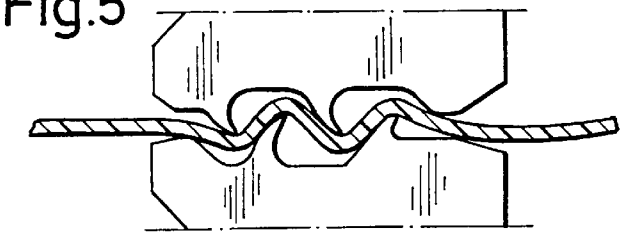
FIG. 5 shows a fifth embodiment of a clamping section of a thread clamp made in accordance with the invention.

Reference is made to FIGS. 1 to 5, which show different embodiments of clamping sections on a larger scale. The thread clamps described in the following are thread clamps for a gripper projectile of a projectile weaving machine. Thread clamps of this kind are formed in the shape of a U and have a clamping section at the free end of the limbs. FIG. 1 shows a preferred embodiment of a clamping section. The clamping section is formed by elevations 2 and depressions 3 which extend transverse to the laying-in direction of the thread 4 which is to be held firmly by the thread clamp. The elevations are arranged to lie opposite to the depressions and formed in such a manner that a free space 5 is present when the thread clamp is closed. The elevations have a sawtooth-like cross-section, with one flank 6 being made straight and the other flank 7 sinusoidal. An edge 8 is thereby formed. The elevations 2 can have the same cross-section or, for certain thread types, different cross-sections from the entrance to the exit.

The clamping sections illustrated in FIGS. 2 to 5 differ from that of FIG. 1 through the cross-sectional form of the elevations and the depressions.

As a result of the association of the elevations and depressions, as well as the edge at the elevations, a free space for the thread arises, on the one hand, and a kinking action and a notching action are achieved at the thread, on the other hand, by means of which the thread is held securely.

Figures 6A, 6B:
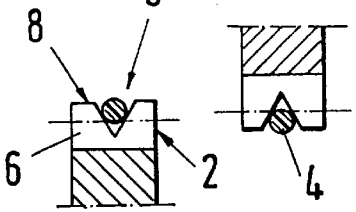
FIGS. 6*a, b* show a modification of the embodiments shown in FIGS. 1 to 5.

As FIGS. 6*a*, 6*b* and 7 show, the elevation can be provided with a notch 9. The notches are formed lying on a line in the crown of the elevation in the laying-in direction of the thread 4 which is to be held firmly by the thread clamp. Instead of the notch a trough can also be provided. With this measure a wedge action can be produced in addition to the kinking action and/or the notch action in an advantageous manner. The individual notches can be formed laterally displaced in the elevations with respect to the named laying-in direction. Here a coulier effect can also be achieved at the same time in order to further improve the holding of the thread.

FIG. 8 shows a clamping section of a sixth embodiment which is secured to a limb 10 of the thread clamp. In this embodiment the elevations 11 are formed as plates which are secured to a base plate 12 at a spacing from one another. The plates 11 are substantially triangular and arranged with respect to one another in such a manner that when the clamp is closed a passage for a thread is formed between the two clamping sections which is analogous to the embodiment with notches.

Reference is made to FIGS. 9 to 12. The illustrated embodiments differ from those described above substantially in that the elevations 15 and depressions 16 are formed to lie opposite one another and that the individual elevations 15 or the entire clamping section 17 are elastically deformable. For this, desired bending locations 18, 19 are provided at the roots of the individual elevations 15 or between the clamping section and the limbs 20 of the thread clamp. In analogy to the above-described embodiments, notches 9 can be formed in the elevations. It is pointed out that in these embodiments the elevations and depressions can be formed in such a manner that the elevations of the one clamping section engage in the depressions of the other clamping section.

The above described thread clamps can be used as thread server clamps and projectile clamps in projectile weaving machines as well as rapier clamps in rapier weaving machines.

What is claimed is:

1. Thread clamp for a weaving machine, said thread clamp having cooperating clamping sections for opening or closing with elevations and depressions which extend transverse to the laying-in direction of a thread to be held firmly by the thread clamp, characterized in that when the clamp is closed, a free space is in each case provided between the elevations and depressions for the reception of a thread; and in that the elevations have an edge for holding back the thread.

2. Thread clamp in accordance with claim 1 characterized in that the elevations of the one clamping section engage in the depressions of the other clamping section.

3. Thread clamp in accordance with claim 1 characterized in that the elevations have a sawtooth-like cross-section.

4. Thread clamp in accordance with claim 1 characterized in that the elevations have a claw-like cross-section.

5. Thread clamp in accordance with claim 1 characterized by a cut-out which is formed transverse to the elevation in a crown formed by the elevation.

6. Thread clamp in accordance with claim 1 characterized by a basic body at which the clamping sections are formed or fastened.

7. Thread clamp in accordance with claim 1 characterized in that the elevations are formed as plate-like members which are arranged on a carrier part at a spacing with respect to one another.

8. Thread clamp in accordance with claim 1 characterized in that the elevations and the depressions are arranged substantially opposite one another.

9. Thread clamp in accordance with claim 1 characterized in that the elevations are elastically deformable.

10. A weaving machine comprising a thread clamp for releasably grasping a thread being used by the weaving machine, the thread clamp including cooperating and selectively openable and closable clamping sections defining opposing elevations and depressions which are oriented transversely to a laying-in direction of the thread, the elevations and depressions defining a free space for receiving the thread when the clamping sections are opened, the elevations further defining edges for holding the thread when the clamping sections are closed.

* * * * *